US009225080B2

(12) United States Patent
Himeno et al.

(10) Patent No.: US 9,225,080 B2
(45) Date of Patent: Dec. 29, 2015

(54) TERMINAL CONNECTING-AND-FIXING STRUCTURE

(71) Applicant: Mitsubishi Nichiyu Forklift Co., Ltd., Nagaokakyo-shi, Kyoto (JP)

(72) Inventors: Takamitsu Himeno, Tokyo (JP); Atsushi Nakao, Tokyo (JP); Hitoshi Tamaki, Tokyo (JP); Naoto Kawauchi, Tokyo (JP); Satoshi Matsuda, Tokyo (JP)

(73) Assignee: MITSUBISHI NICHIYU FORKLIFT CO., LTD., Kyoto (JP)

( * ) Notice: Subject to any disclaimer, the term of this patent is extended or adjusted under 35 U.S.C. 154(b) by 0 days.

(21) Appl. No.: 14/371,469

(22) PCT Filed: Oct. 17, 2012

(86) PCT No.: PCT/JP2012/076804
§ 371 (c)(1),
(2) Date: Jul. 10, 2014

(87) PCT Pub. No.: WO2013/114687
PCT Pub. Date: Aug. 8, 2013

(65) Prior Publication Data

US 2014/0349527 A1 Nov. 27, 2014

(30) Foreign Application Priority Data

Feb. 3, 2012 (JP) ..... 2012-022160

(51) Int. Cl.
*H01R 4/28* (2006.01)
*H01R 4/30* (2006.01)
(Continued)

(52) U.S. Cl.
CPC ..... *H01R 4/302* (2013.01); *H01R 4/32* (2013.01); *H01R 4/54* (2013.01); *H01R 13/621* (2013.01)

(58) Field of Classification Search
CPC ..... H01R 4/302; H01R 4/32; H01R 4/54; H01R 4/30; H01R 13/621
USPC ..... 439/754
See application file for complete search history.

(56) References Cited

U.S. PATENT DOCUMENTS 6,347,966 B1 2/2002 Hielscher
7,344,421 B1 3/2008 Spencer
(Continued)

FOREIGN PATENT DOCUMENTS

EP 1 696 546 A2 8/2006
GB 221914 A 9/1924
(Continued)

*Primary Examiner* — Javaid Nasri
(74) *Attorney, Agent, or Firm* — Birch, Stewart, Kolasch & Birch, LLP

(57) ABSTRACT

A terminal connecting-and-fixing structure capable of ensuring the connection between the terminal and the bus bar even in the case of loose of the bolt and suppressing increase in the contact resistance, thereby preventing poorness of the conduction, is provided. A terminal connecting-and-fixing structure comprises a bus bar 10 having a plate-like shape, a bolt 30 penetrating the bus bar 10, and a nut 40 tightened by the bolt 30, and a terminal 20 mounted on the bolt 30, wherein the terminal 20 and the bus bar 10 is connected and fixed by fastening the nut 40 to the bolt 30, and wherein the bus bar 10 has a concave portion 12, and the terminal 20 and the bus bar 10 is connected and fixed by fastening the nut 40 to the bolt 30 while an end portion of the terminal 20 is press-fitted in the concave portion 12.

8 Claims, 9 Drawing Sheets

(51) Int. Cl.

| | |
|---|---|
| ***H01R 4/00*** | (2006.01) |
| ***H01R 4/32*** | (2006.01) |
| ***H01R 13/621*** | (2006.01) |

(56) References Cited

U.S. PATENT DOCUMENTS

2010/0084205 A1* 4/2010 Tarchinski et al. ..... 180/65.1
2012/0227389 A1 9/2012 Hinderks

FOREIGN PATENT DOCUMENTS

| | | | |
|---|---|---|---|
| JP | 50-63494 | A | 5/1975 |
| JP | 2005-16355 | A | 1/2005 |
| JP | 3120249 | U | 3/2006 |
| JP | 2007-124751 | A | 5/2007 |
| JP | 2009-181944 | A | 8/2009 |
| JP | 2011-518280 | A | 6/2011 |
| WO | WO 96/15577 | A1 | 5/1996 |

* cited by examiner

Cross-sectional view along line A-A

Cross-sectional view along line B-B

Related Art

TERMINAL CONNECTING-AND-FIXING STRUCTURE

TECHNICAL FIELD

The present invention relates to a terminal connecting-and-fixing structure, particularly to a terminal connecting-and-fixing structure comprising a bus bar having a plate-like shape, a bolt penetrating the bus bar, and a nut tightened by the bolt, and a terminal mounted on the bolt, wherein the terminal and the bus bar is connected and fixed by fastening the nut to the bolt.

BACKGROUND

Electric vehicle driven by a motor, such as a battery-powered forklift has an inverter mounted thereon to convert a DC voltage charged in a battery to an AC voltage, and the inverter has a terminal portion to which a cable connected to e.g. a motor is to be connected. FIG. 10 is a schematic diagram illustrating a conventional terminal connecting-and-fixing structure.

As illustrated in FIG. 10, a conventional terminal connecting-and-fixing structure 100 comprises a bus bar 110 having a plate-like shape, a bolt 130 penetrating the bus bar 110, and a terminal 120 mounted on the bolt 130. Further, the terminal 120 and the bus bar 110 is connected and fixed by fastening the nut 140 to the bolt 130, whereby the terminal 120 and the bus bar 110 are electrically continued.

CITATION LIST

Patent Literature

Patent Document 1: JP2005-16355 A

SUMMARY

Technical Problem

In general, the terminal 120 and the bolt 130 are composed of different materials and have different linear expansion coefficients. Thus, when the terminal connecting-and-fixing structure is kept in a high-temperature environment, the fastening of the bolt 130 may be loosened due to the difference in the amount of thermal expansion between the two. Further, the fastening of the bolt 130 may also be loosened by e.g. vibration. If the fastening of the bolt 130 is loosened as above, the contact resistance between the terminal 120 and the bus bar 110 may be increased, and the conduction therebetween may become poor.

In particular, as a battery-powered forklift employs a high-output inverter in terms of easiness of vehicle installation and is placed in an enclosed space in terms of dust-proof property and waterproof property, the terminal connecting-and-fixing structure 100 is likely to be kept in a high-temperature environment. Further, as a forklift is started and stopped repeatedly in operation, vibration is likely to occur. Thus, there has been a problem such that poorness of conduction as described above is likely to arise.

Patent document 1 discloses a stud bolt type terminal device having a structure where an O-ring is disposed at the boundary between a stud bolt and a resin mold cover in order to prevent entrance of foreign matters from an interspace resulting from a difference between the linear expansion coefficient of the stud bolt and the linear expansion coefficient of the resin mold cover. However, Patent Document 1 does not refer at all to preventing increase in the contact resistance due to the loose of the bolt.

The present invention has been made in view of the above problems and is to provide a terminal connecting-and-fixing structure capable of ensuring the connection between the terminal and the bus bar even in the case of loose of the bolt and suppressing increase in the contact resistance, thereby preventing poorness of the conduction.

Solution to Problem

The present invention has been made to accomplish an object as above and provides a terminal connecting-and-fixing structure comprising:

- a bus bar having a plate-like shape;
- a bolt penetrating the bus bar, and a nut tightened by the bolt; and
- a terminal mounted on the bolt;
- wherein the terminal and the bus bar is connected and fixed by fastening the nut to the bolt; and
- wherein the bus bar has a concave portion, and the terminal and the bus bar is connected and fixed by fastening the nut to the bolt while an end portion of the terminal is press-fitted in the concave portion.

Accordingly in the present invention, the bus bar has a concave portion, and the terminal and the bus bar is connected and fixed by fastening the nut to the bolt while an end portion of the terminal is press-fitted in the concave portion. That is, the terminal and the bus bar is connected and fixed by press fitting, which provides a structure where the bus bar and the terminal are hard to be separated even if the bolt is loosened. Further, the terminal and the bus bar are in contact with each other not only at the end of the terminal and the bottom surface of the concave portion, but also at the outer peripheral surface of the terminal and the inner peripheral surface of the bus bar, whereby it is possible to ensure a large contact area relative to a conventional structure thereby to suppress the contact resistance.

It is preferred that the terminal is made from a material having a linear expansion coefficient higher than a material of the bus bar.

According to such a construction, when the terminal connecting-and-fixing structure is kept in a high-temperature environment and the terminal and the bus bar are thermally expanded, the press fit interference will not be decreased due to thermal expansion as the thermal expansion amount of the terminal is larger than the bus bar. Thus it is possible to connect and fix the terminal and the bus bar steadily even in a high-temperature environment.

It may be that the end portion of the terminal and the concave portion have a pair of engagement means configured so that the end portion of the terminal is engaged with the concave portion by turning the terminal a prescribed degree around an axis of the bolt while the end portion of the terminal is press-fitted in the concave portion.

When such an engagement means is formed in the end portion of the terminal and the concave portion of the bus bar, it is possible to connect and fix the terminal and the bus bar steadily without separation even if the bolt is loosened.

The concave portion may have an opening end having a foldable collar portion projecting along a radial direction.

When such a collar portion is formed, it is possible to ensure a connection at least between the collar portion and the outer peripheral surface of the terminal even when the bolt is loosened and moved in the axial direction.

It may be that a brazing material is disposed on an edge portion of the opening end of the concave portion.

When a brazing material is disposed on an edge portion of the opening end of the concave portion as above, the brazing material will be melted in a high-temperature environment, whereby it is possible to ensure a large contact area between the terminal and the bus bar. Further, a gap which is possibly formed between the end portion and the concave portion of the bus bar can be filled with the brazing material, whereby it is possible to improve the waterproof property and the dust-proof property in the connecting-and-fixing portion.

In this case, it is preferred that at least one of an inner peripheral surface or a bottom surface of the concave portion has a groove in which the brazing material being melted is to be flown because it is thereby possible to allow the molten brazing material to conductively flow between the end portion and the concave portion of the bus bar.

It is preferred that the bolt is made from the same material as the material of the terminal.

By employing such a structure, it is possible to suppress loose of the bolt itself arising from the difference in the thermal expansion coefficient between the bolt and the terminal.

Advantageous Effects

According to the present invention, it is possible to provide a terminal connecting-and-fixing structure capable of ensuring the connection between the terminal and the bus bar even in the case of loose of the bolt and suppressing increase in the contact resistance, thereby preventing poorness of the conduction. The terminal connecting-and-fixing structure according to the present invention may preferably be used for an inverter to be mounted on a battery-powered forklift.

BRIEF DESCRIPTION OF DRAWINGS

FIG. 4(*a*) is a plan view of a bus bar, FIG. 4(*b*) is a cross-sectional view along the line A-A, and FIG. 4(*c*) is a cross-sectional view along the line B-B.

FIG. 6(*a*) is a schematic plan view, and FIG. 6(*b*) is a schematic cross-sectional view.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention. In the following, an example where a terminal connecting-and-fixing structure according to the present invention is applied to an inverter which is to be mounted on a battery-powered forklift will be described; however, it should be understood that use of the terminal connecting-and-fixing structure according to the present invention is by no means limited thereto.

(First Embodiment)

Figure 1A:
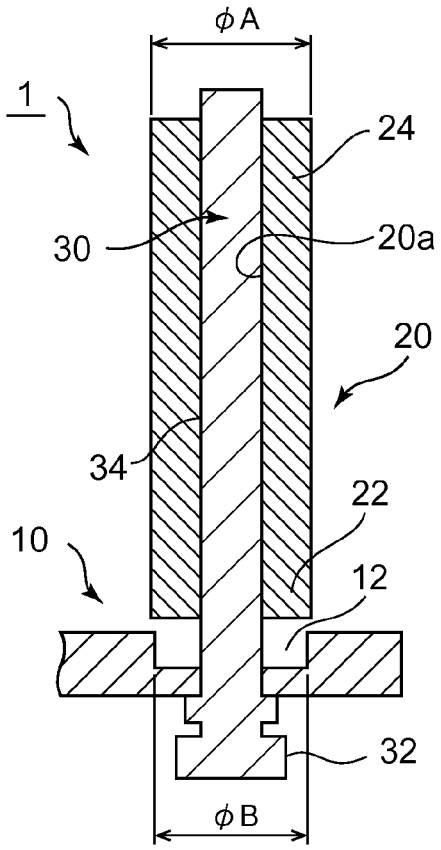
FIGS. 1(*a*) and (*b*) are schematic cross-sectional views illustrating a terminal connecting-and-fixing structure according to a first embodiment of the present invention.
Figure 1B:
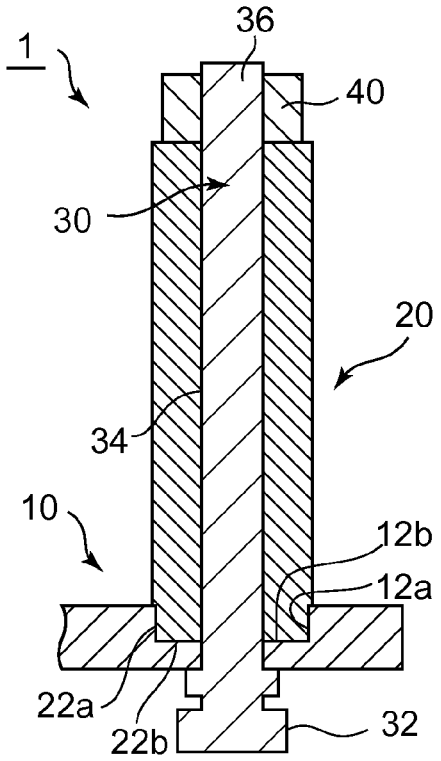

FIGS. 1(*a*) and (*b*) are schematic cross-sectional views illustrating a terminal connecting-and-fixing structure according to a first embodiment of the present invention. As illustrated in FIGS. 1(*a*) and (*b*), the terminal connecting-and-fixing structure 1 comprises a bus bar 10 having a plate-like shape, a bolt 30 penetrating the bus bar 10 and a nut 40 tightened by the bolt 30, and a terminal 20 mounted on the bolt 30.

The bus bar 10 is a member made from cupper and having a plate-like shape and is a member through which an AC current converted from a DC current by an inverter (not shown) flows. The bus bar 10 has, as seen in FIG. 1(*a*), a concave portion 12 thereon, which is depressed relative to its surrounding area in a concave shape. The shape of this concave portion 12 in a plan view is not particularly limited, and in this embodiment, it has a round shape having a diameter B.

The terminal 20 is a member having, for example, a cylindrical shape made from brass, and it has an end portion 22 to be connected with the bus bar 10 to allow a flow therein of an AC current flowing through the bus bar 10. The terminal 20 has a central hole 20*a*, of which shape is not particularly limited but is, for example, a cylindrical shape having a slightly larger diameter A than the diameter B of the concave portion 12.

The bolt 30 is, for example, a member made from iron and having a rod-like shape and has a spiral-shaped groove on a surface of its shaft portion 34. The shaft portion 34 is inserted into the central hole 20*a* of the terminal 20. On the opposite side of the terminal 20 across the bus bar 10, a head portion 32 having a larger diameter than the shaft portion 34 is formed. The nut 40 is, for example, a ring-like member made from iron, which is screwable with the shaft portion 34 of the bolt 30.

In the terminal connecting-and-fixing structure 1 of the present invention having such a configuration, as seen in FIG. 1(*b*), the end portion 22 and the concave portion 12 of the bus bar 10 are connected and fixed by fastening the nut 40 to the tip portion 36 of the bolt 30 while the end portion 22 of the terminal 20 is press-fitted in the concave portion 12 of the bus bar 10.

That is, in the terminal connecting-and-fixing structure 1 according to the present invention, the bus bar 10 and the terminal 20 are hard to be separated even when the bolt 30 is loosened as the terminal 20 and the bus bar 10 are connected and fixed by press fitting. Further, in the terminal connecting-and-fixing structure 1, the terminal 20 and the bus bar 10 are in contact with each other not only at the end 22*b* and the bottom surface 12*b* but also at the outer peripheral surface 22*a* and the inner peripheral surface 12*a*, whereby it is possible to ensure a large contact area, thereby to suppress the contact resistance.

Further, as described above, as the bus bar 10 is made from cupper and the terminal 20 is made from brass, the material of the terminal 20 has a linear expansion coefficient larger than the bus bar 10. Accordingly, when the terminal connecting-and-fixing structure 1 is kept in a high-temperature environment and the terminal 20 and the bus bar 10 are thermally expanded, the press fit interference will not be decreased due to thermal expansion. Therefore, it is possible to connect and fix the terminal 20 and the bus bar 10 steadily even in a high-temperature environment.

(Second Embodiment)

Figure 2A:
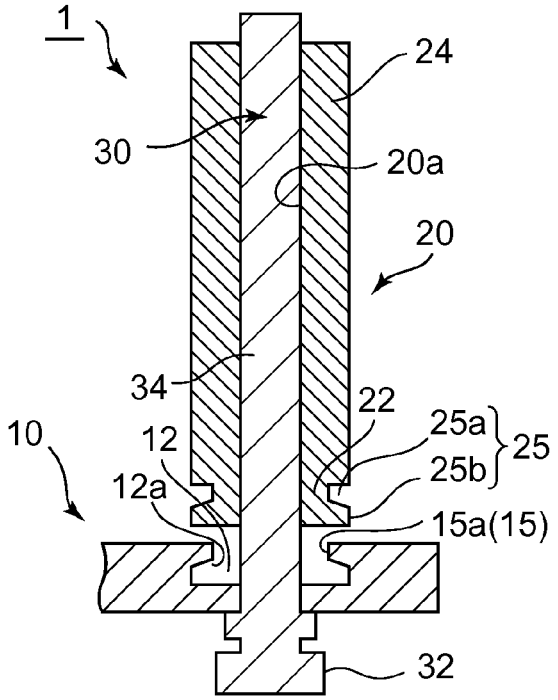
FIGS. 2(*a*) and (*b*) are schematic cross-sectional views illustrating a terminal connecting-and-fixing structure according to a second embodiment of the present invention.
Figure 2B:
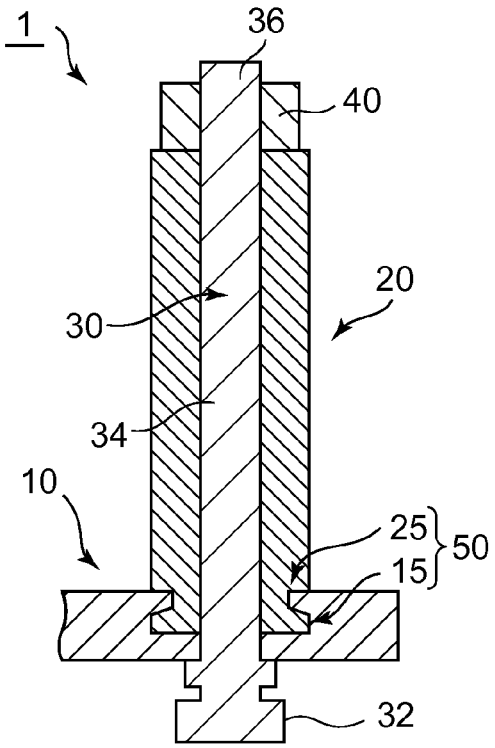
Figure 3A:
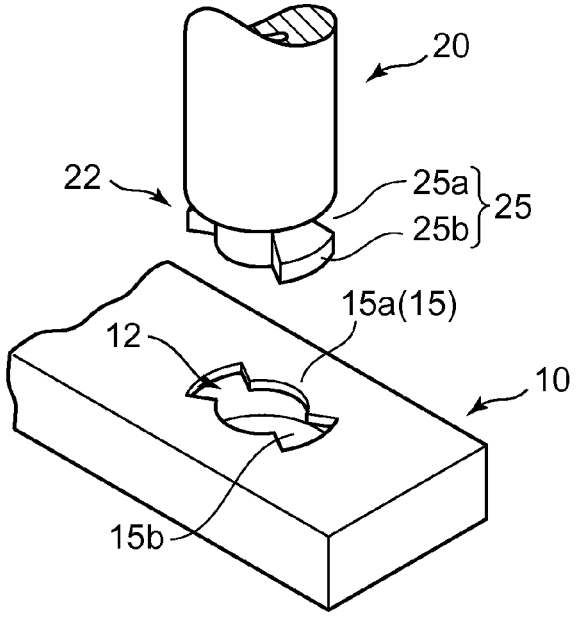
FIGS. 3(*a*) to (*c*) are schematic perspective views illustrating a method of assembling the terminal connecting-and-fixing structure according to the second embodiment of the present invention.
Figure 3B:
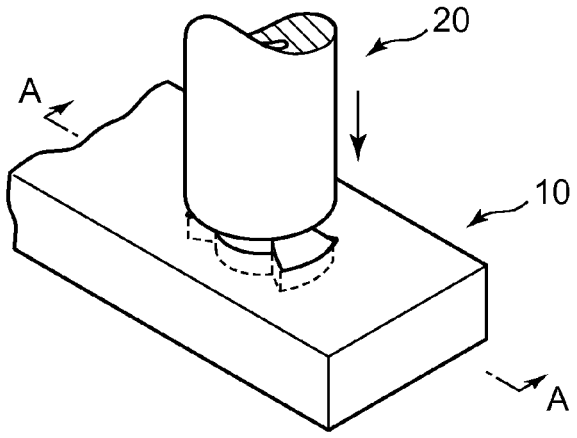
Figure 3C:
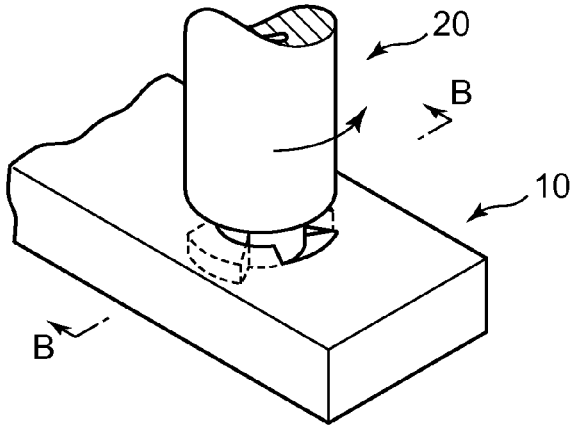
Figure 4A:
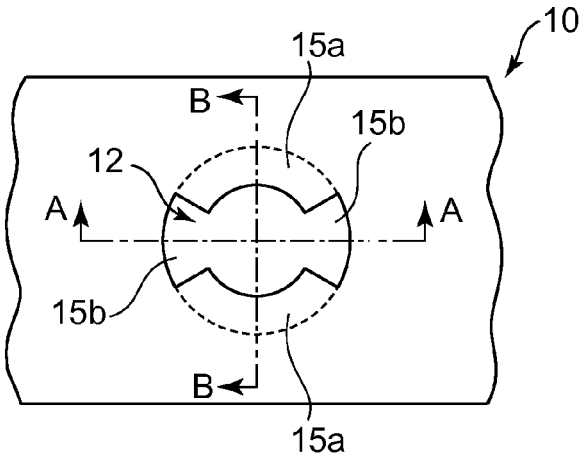
FIGS. 4(*a*) to (*c*) are schematic diagrams illustrating a method of assembling the terminal connecting-and-fixing structure according to the second embodiment of the present invention.
Figure 4B:
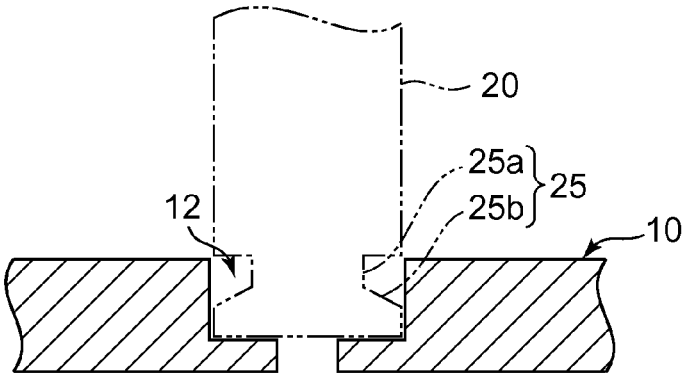
Figure 4C:
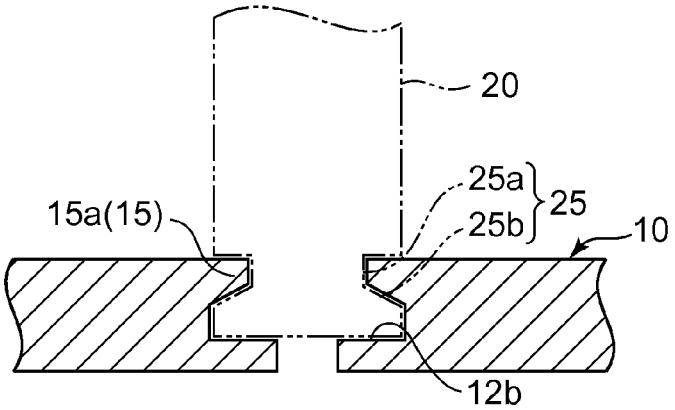

Now, a second embodiment of the present invention will be described with reference to FIG. 2 to FIG. 4. FIGS. 2(*a*) and (*b*) are schematic cross-sectional views illustrating a terminal connecting-and-fixing structure according to the second embodiment; FIG. 3 and FIG. 4 are diagrams each illustrating a method of assembling the terminal connecting-and-fixing structure according to the second embodiment, and FIGS. 3(*a*) to (*c*) are schematic perspective views illustrating the assembling method. FIG. 4(*a*) is a plan view of a bus bar 10, FIG. 4(*b*) is a cross-sectional view along the line A-A in FIG. 3(*b*) and FIG. 4(*a*), and FIG. 4(*c*) is a cross-sectional view along the line B-B in FIG. 4(*a*). The terminal connecting-and-fixing structure according to the second embodiment fundamentally has the same structure as the above-described terminal connecting-and-fixing structure, and the same elements as those of the above embodiment are assigned with the same reference numerals as those of the above embodiment, and the same description thereof will be omitted.

In the terminal connecting-and-fixing structure 1, the end portion 22 of the terminal 20 has a terminal-side engagement means 25 comprising a concave part 25*a* and a convex part 25*b*, and the inner peripheral surface 12*a* of the concave portion 12 has a bus bar-side engagement means 25 comprising a convex part 15*a*. Further, as illustrated in FIG. 2(*b*), the terminal-side engagement means 25 and the bus bar-side engagement means 15 are configured so that they are engageable with each other. That is, the pair of engagement means 50 in the present invention comprises the terminal-side engagement means 25 and the bus bar-side engagement means 15.

The concave part 25*a* of the terminal-side engagement means 25 is, as seen in FIG. 3(*a*), formed all over the circumference of the outer surface of the end portion 22. On the other hand, the convex part 25*b* of the terminal-side engagement means 25 is formed not all over the circumference but partially in the circumferential direction. In this embodiment, the convex part 25*b* is formed in two positions 180 degrees apart from each other.

The convex part 15*a* of the bus bar-side engagement means 15 is, as seen in FIG. 4(*a*), formed not all over the circumference but partially along the circumferential edge of the concave portion 12. In the portion where the convex part 15*a* is not formed, an opening portion 15*b* is formed. In this embodiment, the opening portion 15*b* is formed in two positions 180 degrees apart from each other.

As illustrated in FIGS. 3(*a*) to (*c*), the convex part 25*b* of the terminal 20 is inserted to fit into the opening portion 15*b* to press fit the end portion 22 of the terminal 20 into the concave portion 12. FIG. 3(*b*) and FIG. 4(*b*) illustrate such a condition. Then, by turning the terminal 20 a prescribed angle (e.g. 90 degrees) around an axis of the bolt 30, the convex part 25*b* of the terminal 20 is held between the convex part 15*a* and the bottom surface 12*b* of the concave portion 12, as seen in FIG. 3(*c*) and FIG. 4(*c*), whereby the terminal-side engagement means 25 are engaged with the bus bar-side engagement means 15. In FIG. 3 and FIG. 4, the head portion of the bolt 30 is omitted for the convenience of drawing.

Accordingly, the terminal connecting-and-fixing structure 1 according to this embodiment has a pair of engagement means 50 configured so that the end portion 22 of the terminal 20 are engaged with the concave portion 12 by turning the terminal 20 a prescribed angle around an axis of the bolt 30 while the end portion 22 of the terminal 20 is press-fitted in the concave portion 12 of the concave portion 12. Thus, it is thereby possible to connect and fix the terminal 20 and the bus bar 10 steadily without separation even if the bolt 30 is loosened.

(Third Embodiment)

Figure 5A:
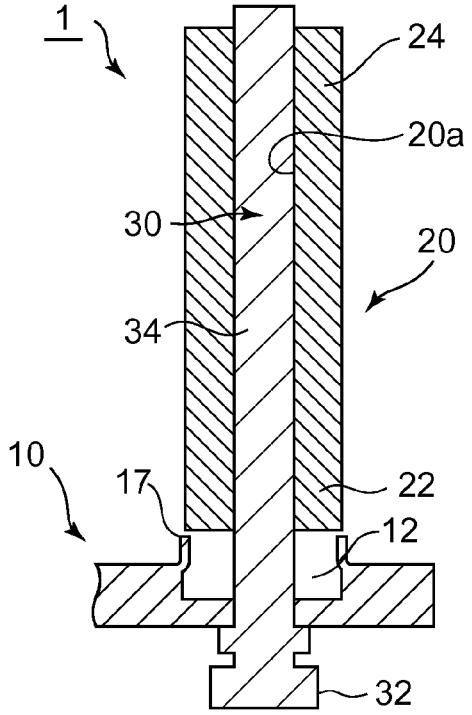
FIGS. 5(*a*) and (*b*) are schematic cross-sectional views illustrating a terminal connecting-and-fixing structure according to a third embodiment of the present invention.
Figure 5B:
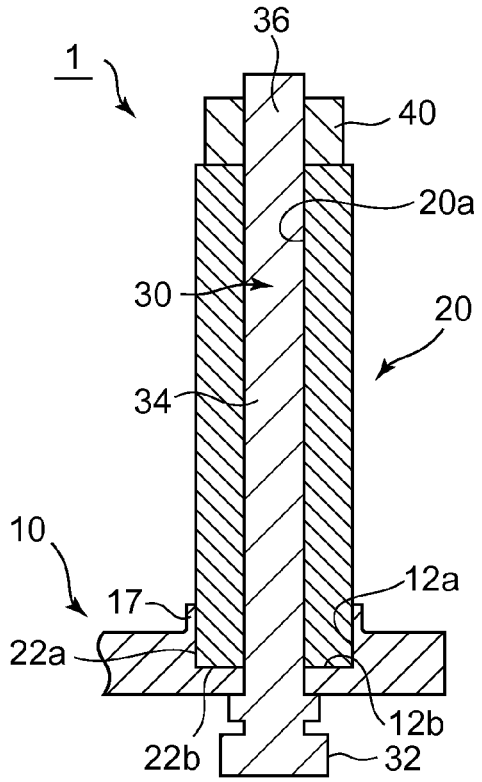

Now, a third embodiment of the present invention will be described with reference to FIG. 5 and FIG. 6. FIGS. 5(*a*) and (*b*) are schematic cross-sectional views illustrating the terminal connecting-and-fixing structure according to the third embodiment, and FIGS. 6(*a*) and (*b*) are diagrams illustrating a bus bar according to the third embodiment. The terminal connecting-and-fixing structure according to the this embodiment fundamentally has the same structure as the terminal connecting-and-fixing structure according to the first embodiment, and the same elements as those of the first embodiment are assigned with the same reference numerals as those of the first embodiment, and the same description thereof will be omitted.

The terminal connecting-and-fixing structure 1 according to this embodiment is different from the first embodiment in that the concave portion 12 has an opening end having a foldable collar portion 17, as illustrated in FIGS. 5(*a*) and (*b*). The collar portion 17 is formed so as to project along a radial direction in the opening end portion of the concave portion 12, as illustrated in FIG. 6(*b*). Further, as illustrated in FIG. 6(*a*), the color portion 17 is foldable because of a plurality of cuts 17*a* formed at the portion projecting along the radial direction.

Figure 6A:
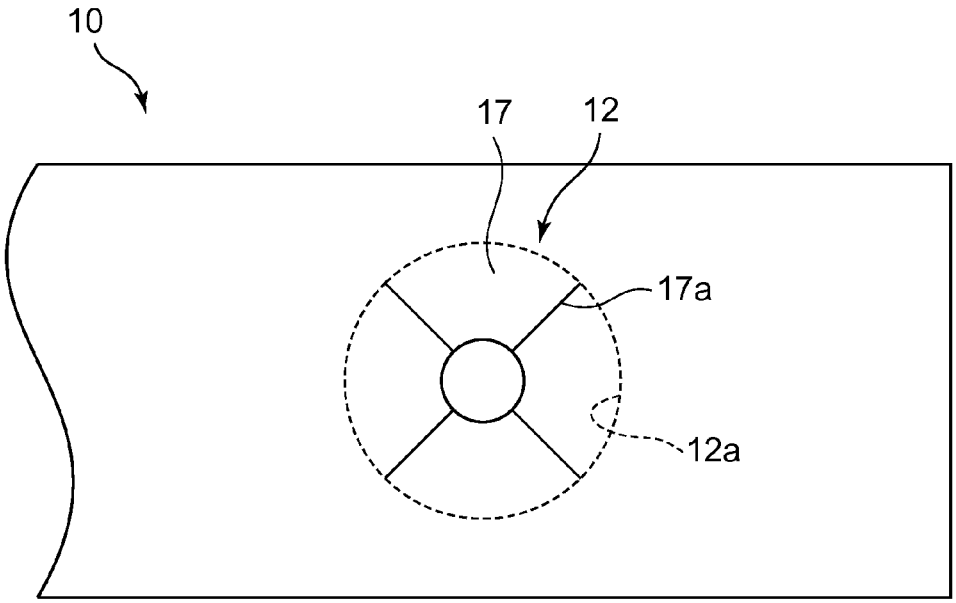
FIGS. 6(*a*) and (*b*) are diagrams illustrating a bus bar according to the third embodiment of the present invention.
Figure 6B:
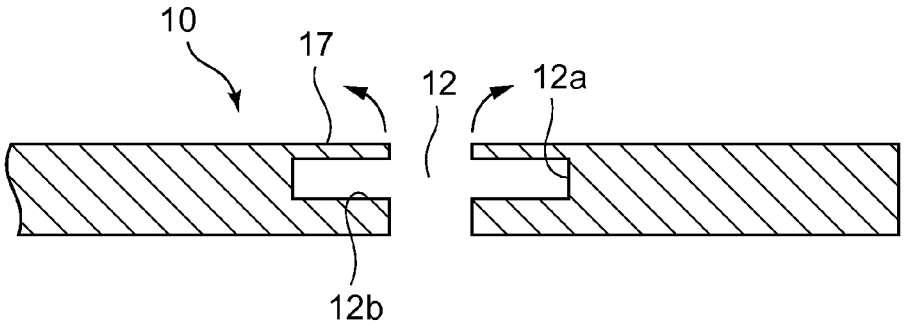

Further, the terminal connecting-and-fixing structure 1 according to this embodiment is obtained by folding the collar portion 17 upward as indicated by the arrows in FIG. 6(*b*), and then press fitting the end portion 22 of the terminal 20 into the concave portion 12.

According to the terminal connecting-and-fixing structure 1 of this embodiment, the concave portion 12 has an opening end having a foldable collar portion 17 projecting along a radial direction, whereby it is possible to ensure the connection at least between the collar portion 17 and the outer peripheral surface 22*a* of the end portion 22 of the terminal 20 even when the bolt 30 is loosened and moved in the axial direction.

(Fourth Embodiment)

Figure 7A:
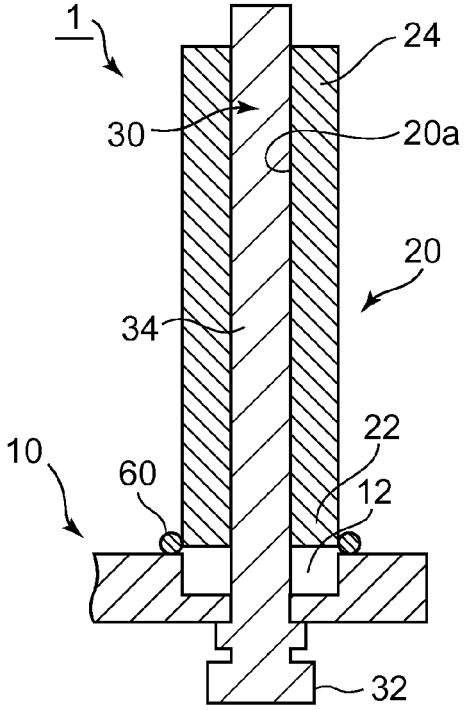
FIGS. 7(*a*) and (*b*) are schematic cross-sectional views illustrating a terminal connecting-and-fixing structure according to a fourth embodiment of the present invention.
Figure 7B:
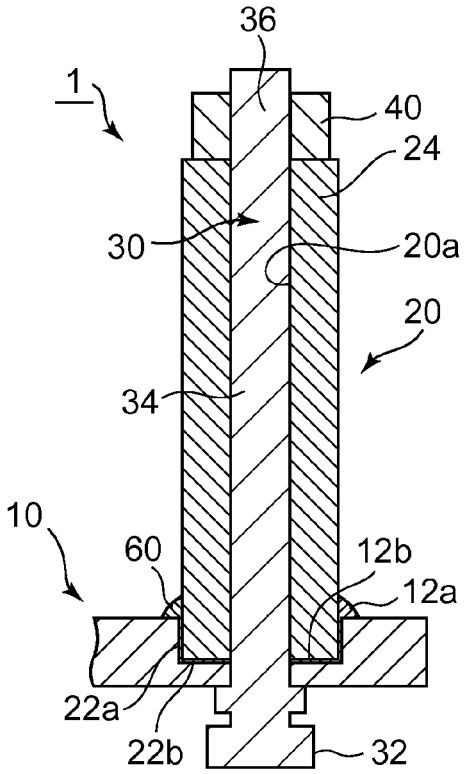
Figure 8A:
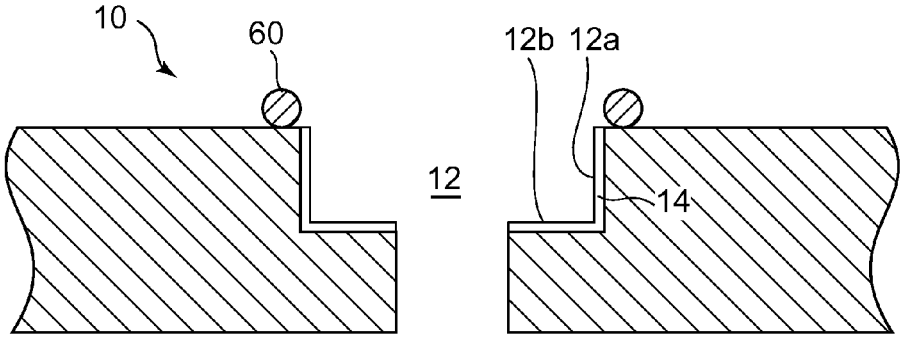
FIGS. 8(*a*) and (*b*) are schematic diagrams of a variation of the terminal connecting-and-fixing structure of the fourth embodiment of the present invention.
Figure 8B:
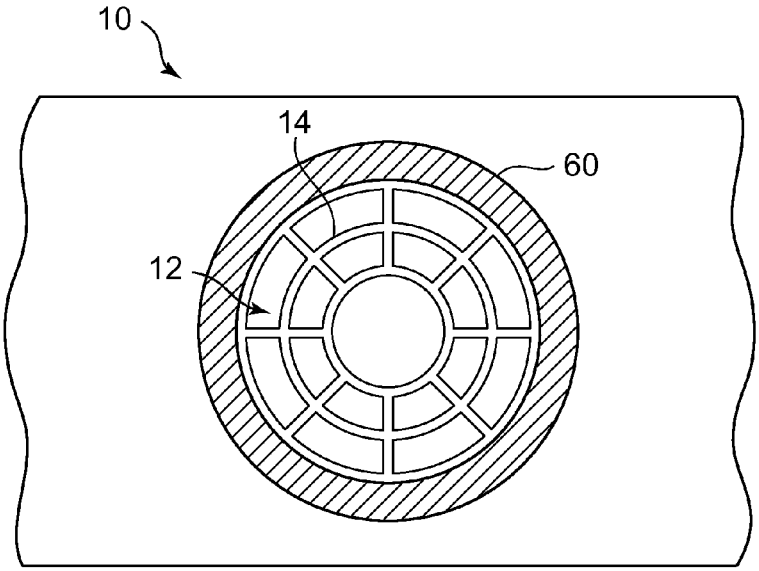
Figure 9:
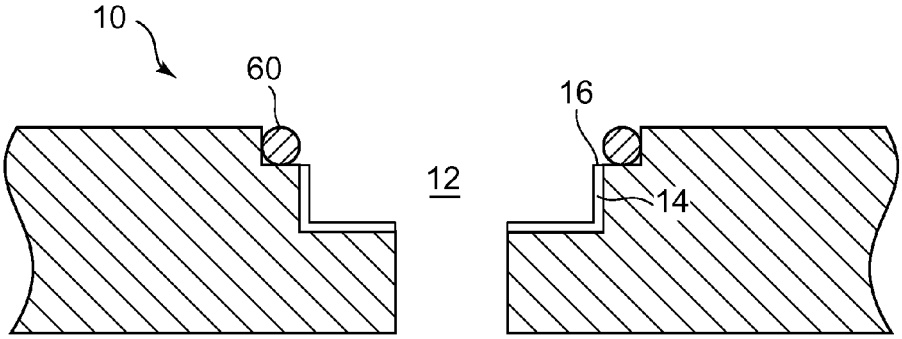
FIG. 9 is a schematic diagram of another variation of the terminal connecting-and-fixing structure of the fourth embodiment of the present invention.
Figure 10:
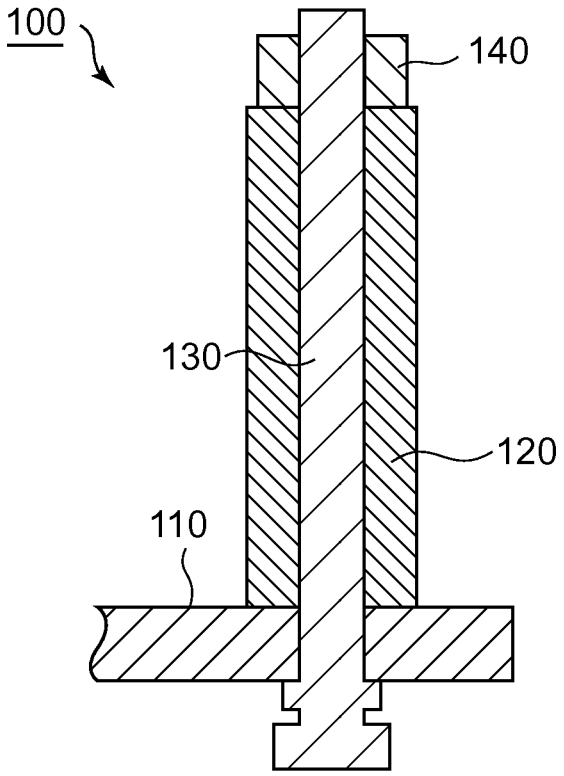
FIG. 10 is a schematic cross-sectional view illustrating a conventional terminal connecting-and-fixing structure.

Now, a fourth embodiment of the present invention will be described with reference to FIG. 7 to FIG. 9. FIGS. 7(*a*) and (*b*) are schematic cross-sectional views illustrating a terminal connecting-and-fixing structure according to a fourth embodiment, and FIG. 8 and FIG. 9 are each a schematic diagram of a variation of the terminal connecting-and-fixing structure of the fourth embodiment. The terminal connecting-and-fixing structure according to the this embodiment fundamentally has the same structure as the terminal connecting-and-fixing structure according to the first embodiment, and the same elements as those of the first embodiment are assigned with the same reference numerals as those of the first embodiment, and the same description thereof will be omitted.

The terminal connecting-and-fixing structure 1 according to this embodiment is different from the first embodiment in that a brazing material 60 is disposed on an edge portion of the opening end of the concave portion 12, as illustrated in FIGS. 7(*a*) and (*b*). The brazing material 60 may, for example, be a ring-like member made from e.g. silver, copper or phosphor copper, and will be melted when the terminal connecting-and-fixing structure 1 is kept in a high-temperature environment. The molten brazing material 60 will flow into a tiny gap formed between the end portion 22 of the terminal 20 and the concave portion 12 of the bus bar 10, whereby the terminal 20 and the bus bar 10 are connected without a gap.

Accordingly, the terminal connecting-and-fixing structure 1 comprises a brazing material 60 disposed on an edge portion of the opening end of the concave portion 12, and the brazing material 60 will be melted to fill a gap formed between the end portion 22 of the terminal 20 and the concave portion 12 of the bus bar 10, whereby it is possible to ensure a large contact area between the terminal 20 and the bus bar 10. Further, a gap which is possibly formed between the end portion 11 of the terminal 20 and the concave portion 12 of the bus bar 10 can be filled with the brazing material, whereby it is possible to improve the waterproof property and the dust-proof property in the connecting-and-fixing portion.

Further, it is preferred that the inner peripheral surface 12*a* and the bottom surface 12*b* of the concave portion 12 has a groove 14 because it is thereby possible to allow the molten brazing material 60 to conductively flow between the end portion 22 of the terminal 20 and the concave portion 12 of the bus bar 10, as illustrated in FIGS. 8(*a*) and (*b*). Further, although not shown in the figure, it may be that only at least one of the inner peripheral surface 12*a* or the bottom surface 12*b* of the concave portion 12 has such a groove 14.

Further, the edge portion of the opening end of the concave portion 12 may have a step portion 16 having a height lower than the surface of the bus bar 10 by a step, as illustrated in FIG. 9. When such a step portion 16 is formed, it is possible to dispose the brazing material 60 on the step portion 16, thereby to facilitate positioning of the brazing material 60 to be disposed. Further, it is also possible to prevent outflow of the molten brazing material 60 to the surface of the bus bar 10.

Some preferred embodiments of the present invention are described above; however, the present invention is by no means limited thereto and further modifications and variations may be made without departing from the scope of the invention.

For example, in the above embodiments, an example where bolt 30 is made from iron and the terminal 20 to be mounted on the shaft portion 34 of the bolt 30 is made from brass, that is, an example where the bolt 30 and the terminal 20 are made from different materials, is described. However, the terminal connecting-and-fixing structure 1 is not limited thereto, and the bolt 30 may be made from the same material (e.g. brass) as the material of the terminal. When the bolt 30 is made from the same material as the material of the terminal 20 as above, they have the same linear expansion, and the thermal expansion amount will also be the same, whereby it is possible to suppress loose of the bolt 30 itself arising from the difference in the thermal expansion coefficient between the bolt 30 and the terminal 20.

INDUSTRIAL APPLICABILITY

The present invention can be used as, for example, a terminal connecting-and-fixing structure for and inverter, preferably as a terminal connecting-and-fixing structure for an inverter to be kept in a high-temperature environment, such as an inverter to be mounted on a battery-powered forklift.

The invention claimed is:

1. A terminal connecting-and-fixing structure comprising:
a bus bar having a plate-like shape;
a bolt penetrating the bus bar, and a nut tightened by the bolt; and
a terminal mounted on the bolt;
wherein the terminal and the bus bar is connected and fixed by fastening the nut to the bolt; and
wherein the bus bar has a concave portion which has a bottom surface, and the terminal and the bus bar is connected and fixed by fastening the nut to the bolt while an end portion of the terminal is press-fitted in the concave portion.

2. The terminal connecting-and-fixing structure according to claim 1, wherein the terminal is made from a material having a linear expansion coefficient higher than a material of the bus bar.

3. The terminal connecting-and-fixing structure according to claim 1, wherein the end portion of the terminal and the concave portion have a pair of engagement means configured so that the end portion of the terminal is engaged with the concave portion by turning the terminal a prescribed angle around an axis of the bolt while the end portion of the terminal is press-fitted in the concave portion.

4. The terminal connecting-and-fixing structure according to claim 1, wherein the concave portion has an opening end having a foldable collar portion projecting along a radial direction.

5. The terminal connecting-and-fixing structure according to claim 1, wherein a brazing material is disposed on an edge portion of the opening end of the concave portion.

6. The terminal connecting-and-fixing structure according to claim 5, wherein at least one of an inner peripheral surface or the bottom surface of the concave portion has a groove in which the brazing material being melted is to be flown.

7. The terminal connecting-and-fixing structure according to claim 1, wherein the bolt is made from the same material as the material of the terminal.

8. The terminal connecting-and-fixing structure according to claim 1, which is used for an inverter to be mounted on a battery-powered forklift.

* * * * *